US007343714B2

(12) United States Patent
Zocco

(10) Patent No.: US 7,343,714 B2
(45) Date of Patent: Mar. 18, 2008

(54) DOOR LIGHT

(76) Inventor: Philip Zocco, 1 Park St., Georgetown, MA (US) 01833-2022

( * ) Notice: Subject to any disclaimer, the term of this patent is extended or adjusted under 35 U.S.C. 154(b) by 0 days.

(21) Appl. No.: 10/705,471

(22) Filed: Nov. 10, 2003

(65) Prior Publication Data

US 2005/0097846 A1 May 12, 2005

(51) Int. Cl.
*E06B 3/00* (2006.01)
*E06B 7/00* (2006.01)

(52) U.S. Cl. ..... 52/204.59; 52/208; 52/213; 52/204.1; 52/204.5; 52/200; 52/311.1; 52/457

(58) Field of Classification Search ..... 52/200, 52/208, 213, 204.1, 204.5, 204.59, 311.1, 52/316, 455
See application file for complete search history.

(56) References Cited

U.S. PATENT DOCUMENTS 1,504,970 A * 8/1924 Pascucci ..... 359/743
2,158,089 A 5/1939 Slick
2,748,263 A * 5/1956 Franck et al. ..... 362/333
2,874,653 A * 2/1959 Ratner ..... 52/14
2,877,342 A * 3/1959 Beach ..... 362/309
D185,976 S 8/1959 Meyer
3,283,142 A * 11/1966 Freeman ..... 362/298
3,914,118 A * 10/1975 Brooke et al. ..... 65/95
3,918,226 A * 11/1975 Naidus ..... 52/232
3,930,160 A * 12/1975 Swinehart ..... 250/361 R
4,120,018 A * 10/1978 Nagel ..... 362/333
4,184,480 A * 1/1980 Kenny ..... 126/704
4,186,723 A * 2/1980 Coppola et al. ..... 126/570
4,337,759 A * 7/1982 Popovich et al. ..... 126/684

(Continued)

OTHER PUBLICATIONS

American National Standard for Safety Glazing Materials Used in Buildings—Safety Performance Specifications and Methods of Test, 1989, ANSI Z97.1-1984 (R1994), American National Standards Institute, New York.

(Continued)

*Primary Examiner*—Jeanette Chapman
(74) *Attorney, Agent, or Firm*—Wolf Greenfield & Sacks

(57) ABSTRACT

A door light is disclosed including an insert having a substantially planar top surface defining a plane. A raised or projecting portion, at least partially surrounded by the planar surface, includes at least two features extending above the plane of the planar surface. The raised portion has a substantially uniform configuration. The insert may be formed of a substantially shatterproof or impact resistant material. The raised portion may include a bullseye pattern or raised concentric rings, which may have one or more truncated sides interrupting at least the outermost concentric ring. The insert may be molded and may be made of plastic, such as acrylic or polycarbonate. The door light may be set within a frame for placement in a door or window, or adjacent the door or window for a side light or transom, on either the exterior or interior of a home.

23 Claims, 11 Drawing Sheets

U.S. PATENT DOCUMENTS 4,420,800 A * 12/1983 Van Horn ..... 362/297
4,484,254 A * 11/1984 Puckett et al. ..... 362/309
4,823,246 A * 4/1989 Dilouya ..... 362/328
5,003,745 A * 4/1991 Fang ..... 52/316
5,097,395 A * 3/1992 Aho et al. ..... 362/551
5,123,211 A * 6/1992 Schlicht et al. ..... 52/202
5,128,848 A * 7/1992 Enders et al. ..... 362/268
5,157,893 A * 10/1992 Benson et al. ..... 52/789.1
5,160,192 A * 11/1992 Sugawara ..... 362/16
5,323,576 A * 6/1994 Gumpert et al. ..... 52/200
5,717,284 A * 2/1998 Anandan et al. ..... 313/493
5,772,302 A * 6/1998 Ishikawa et al. ..... 362/3
5,811,173 A * 9/1998 Eichhorn et al. ..... 428/167
5,843,546 A * 12/1998 Eichhorn ..... 428/38
5,884,104 A * 3/1999 Chase et al. ..... 396/6
5,945,916 A * 8/1999 Collot ..... 340/815.4
6,002,464 A * 12/1999 Fujisawa et al. ..... 349/112
6,088,540 A * 7/2000 Leidig et al. ..... 396/155
6,179,447 B1 * 1/2001 Ishikawa et al. ..... 362/277
6,250,027 B1 * 6/2001 Richards ..... 52/204.59
6,588,163 B2 * 7/2003 Wang et al. ..... 52/316
6,736,534 B1 * 5/2004 Fite ..... 362/576

OTHER PUBLICATIONS

"Back to the Basics with Glass 101 A Refresher Course on Glass Types and Options Available", Architect's Guide to Glass & Metal, Summer 2002, pp. 10-12.
Code of Federal Regulations, § 1201.1, 16 C.F.R. CH. 11, Jan. 1, 2003 Edition, pp. 194-209.
Crown (Bullseye) Bullion Glass, http://www.heritageglasslex.com/page4.html, Jan. 30, 2004.
Pompei & Company, http://www.pompeiglass.com/Bullseye_glass.htm, Aug. 19, 2003.
Simpson Design Gallery II: Mastermark Doors Catalog, 2000.
Simpson Door Company, Door No. 4230, http://www.simpsondoor.com/, Jan. 30, 2004.
Sugar Hollow Glass, "Hand Blown Period Bullseye Window Glass", Architectural Glassblowers, http://www.traditional-building.com/brochure/members/sugarhollow/shtml, Aug. 19, 2003.
Sugar Hollow Glass, http://www.sugarhollowglass.com/, Aug. 19, 2003.
Therma Tru® Exterior Door Systems Catalog, 2002.

* cited by examiner

DOOR LIGHT

FIELD OF INVENTION

The present invention relates generally to inserts for windows and doors, and more particularly to door lights.

BACKGROUND OF INVENTION

Different types of door lights exist to provide light into the interior of homes. Door lights may feature a piece of flat, decorative, cut or stained glass held within a frame that is placed within a door. New door lights typically use tempered glass, laminated glass or acrylic in order to meet current building codes or safety standards for modern doors and windows. Older, more historic, door lights have a hand-blown piece of glass that features a bullseye pattern on the surface of the glass. These hand-blown pieces of glass usually have a center projection with one or more raised concentric rings, but the design frequently is very irregular because they are individually hand-made. These door lights are often found in older homes and are set within a wooden door frame. These older door lights, since they are made of glass, are susceptible to breakage and typically do not meet current building codes or safety standards.

A consumer product safety standard is set forth in 16 C.F.R. § 1201 for glazing materials used or intended for use with architectural products such as doors, including storm and combination doors. These safety requirements are designed to reduce the risk of injury or death when the glazing material is broken. The standard includes impact and environmental test requirements. Other standards exist, including those developed by the American National Standards Institute and found in ANSI Z97.1, which sets forth standards for glazing materials in buildings, also in an attempt to reduce the risk of injury in the event the glazing material is broken.

Although there are exemptions to the standards, such as where the primary purpose is decorative or artistic, it is generally desired that glass placed in doors where the glass might potentially be broken be resistant to impact and/or be made to reduce the likelihood of cutting or piercing injuries when the glazing material is broken. For example, glass in doors and windows is often susceptible to breakage by people, particularly children, who may run into the glass or cause objects to impact and break the glass. Thus, a glazing material is desirable that avoids potential injury by being substantially shatterproof or impact resistant. To meet these codes or standards, the glazing material is usually made of flat tempered glass, laminated glass or acrylic.

When remodeling homes, older wooden doors and windows are often replaced with more energy efficient ones. For example, replacement doors may be made of fiberglass or steel. To meet building codes and safety standards, door lights within these new doors or windows must meet the above described impact and environmental tests. Homeowners, however, typically want to keep the original look of the door light so that the door light matches the period detail of the home. Thus, a substantially shatterproof or impact resistant door light with a bullseye or other three-dimensional pattern is desired.

However, it is difficult to make door lights of tempered or other safety glass with a bullseye or three-dimensional pattern. Because of irregularities in glass with projecting or three-dimensional shapes, the glass may shatter during the process of tempering. A tempered glass door light with a slightly raised modified bullseye is available, however, the raised bullseye lacks uniformity and only has a raised center portion. It is desired to provide a door light that is substantially shatterproof or impact resistant and that includes a uniform projecting or three-dimensional shape or pattern.

SUMMARY OF INVENTION

In one embodiment, an insert for placement in a door light is disclosed. The insert includes a substantially planar top surface defining a plane. A raised portion, at least partially surrounded by the planar top surface, includes at least two features extending above the plane of the planar surface. The raised portion has a substantially uniform configuration. The insert is formed of a substantially shatterproof material.

In another embodiment, a door light is disclosed including an insert having a substantially planar top surface defining a plane, and a projecting portion including at least two features extending above the plane of the planar top surface. The planar top surface at least partially surrounds the raised portion and the raised portion has a substantially uniform configuration. The insert is substantially impact resistant and the insert is molded.

In yet another embodiment, a method of making a frame with a door light is disclosed. The method includes the steps of: molding a door light having raised pattern that has a substantially uniform configuration from a substantially shatterproof material; framing the door light in a frame defining a central opening for exposing at least a part of the raised pattern; and inserting the door light and frame within a door.

BRIEF DESCRIPTION OF DRAWINGS

The objects, advantages and features of this invention will be more clearly appreciated from the following detailed description, when taken in conjunction with the accompanying drawings, wherein like numbers are used for like features, in which.

DETAILED DESCRIPTION

Figure 1:
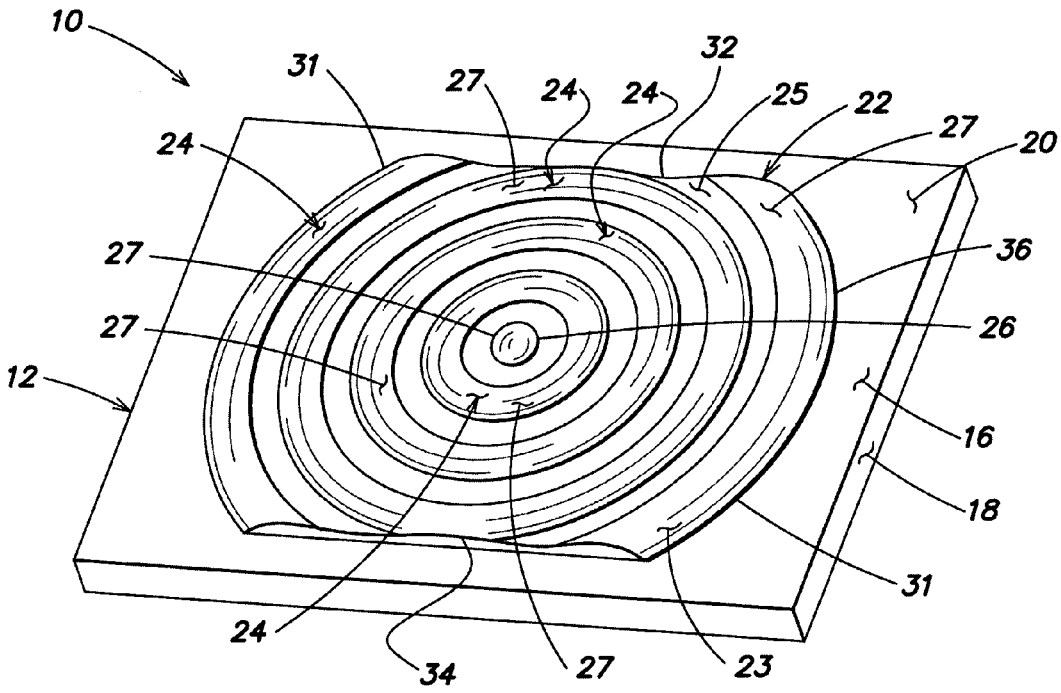
FIG. 1 is a perspective view of one embodiment of a door light according to the present invention.
Figure 2:
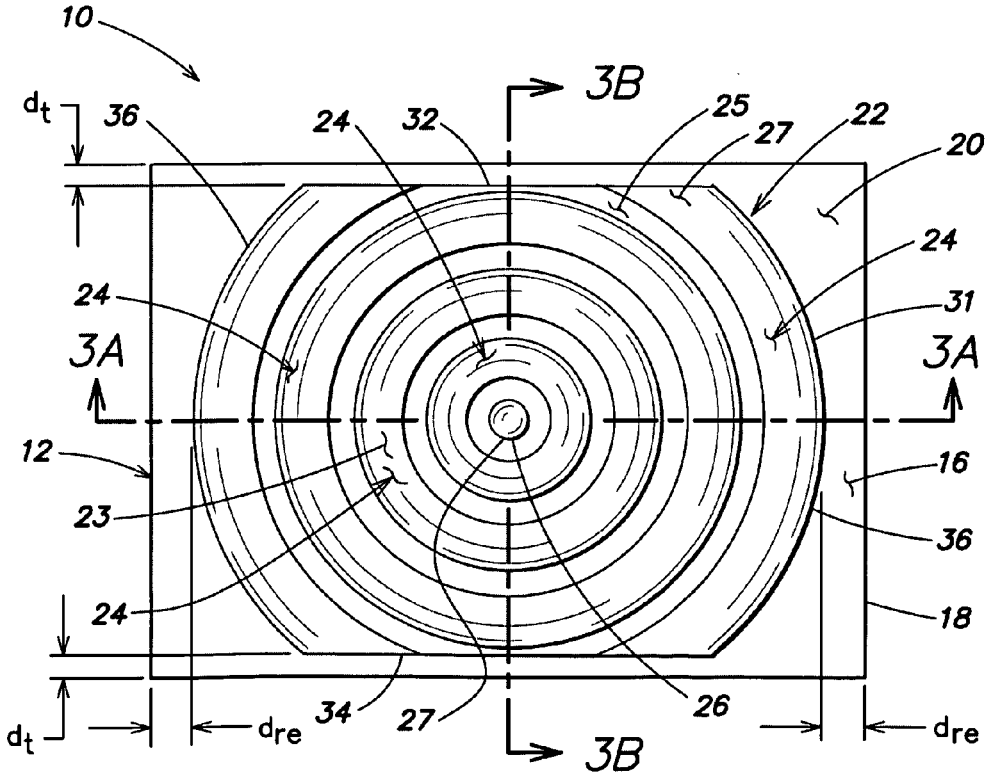
FIG. 2 is a front plan view of the door light of FIG. 1.

With reference now to the drawings, and more particularly to FIGS. 1 and 2 thereof, one aspect of this invention features door light 10. The door light 10 includes an insert 12 that may be set within a frame 14 (see FIGS. 14-17). The frame with the door light 10 may be placed within a door or window, or act as a window on its own. Other types of lights for doors or windows exist, including side lights and transoms. It will be understood that the term "door light" as used herein is intended to cover all such devices. Moreover, door lights and side lights are often referred to in the door industry as "doorlites" and "sidelites".

The insert 12 includes a central portion 16 and an outer edge 18 substantially surrounding the central portion 16. As illustrated, the insert 12 has an overall rectangular shape. However, the insert 12 may have any suitable shape, including square and circular. The insert 12 includes a top surface 20, that is preferably substantially planar. Extending upwardly above a plane $P_1$ defined by the top surface 20 is a projecting or raised portion 22. The raised portion 22 may have any desired three-dimensional shape or pattern and may be surrounded by and centrally disposed on the insert with respect to the top surface 20 of the insert 12, or it may be offset with respect to the center of the insert 12, or raised portion 22 may only be surrounded on one, two or three sides by the top surface 20.

Figure 3B:
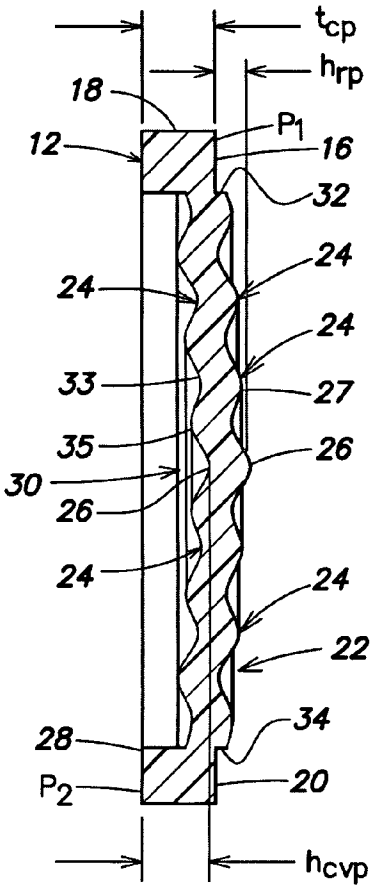
FIG. 3B is a side cross-sectional view of the door light of FIG. 1 taken along line 3B-3B of FIG. 2.
Figure 3A:
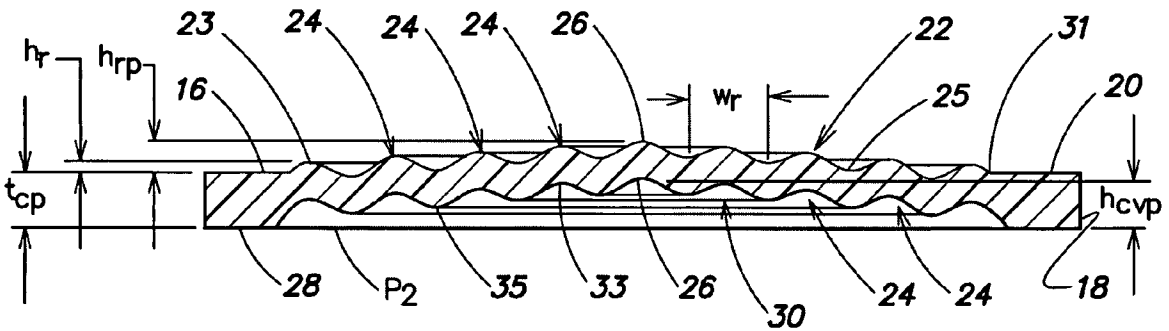
FIG. 3A is a side cross-sectional view of the door light of FIG. 1 taken along line 3A-3A of FIG. 2.

Referring now to FIGS. 3A and 3B, two cross-sections of the insert 12 are shown. The insert 12 has a thickness $t_{cp}$ at its edges while the raised portion 22 extends above the plane of the top surface 20, at its maximum height, a distance $h_{rp}$. The heights above the plane of the top surface 20 of the various parts of the raised portion 22 may be varied, and may feature peaks 23 and valleys 25. Generally, the height $h_{rp}$ of the raised portion 22 may be any suitable distance relative to the thickness $t_{cp}$ of the insert 12 at the top surface 20. As illustrated, the height $h_{rp}$ of the raised portion 22 is at least one-quarter the thickness $t_{cp}$ of the insert 12 at top surface 20, and preferably about half the thickness $t_{cp}$. In one example, the insert 12 has a thickness of about one-half inch at its edges. The thickness of the insert 12 and height of the raised portion 22 increases the distortion as one looks through the insert 12.

Referring again to FIGS. 1 and 2, the raised portion 22 may have any suitable uniform shape or pattern. The uniform raised portion 22 may have at least two raised features 27. In one embodiment illustrated, the raised portion 22 has a bullseye pattern with raised concentric rings 24. A first raised knob 26 is provided in the center, with at least one concentric ring 24 disposed about the knob 26, and in one example, four concentric rings 24 are disposed about the knob 26. It will be appreciated that any number of rings 24 may be provided. The rings 24 may have any desired cross-sectional shape, width $w_r$ and height $h_r$, and the width and/or height of the rings may each be the same or different. The knob 26 may be any suitable size or shape. As illustrated, the concentric rings 24 form a circular pattern on the face of insert 12. However, the rings 24 form any desired pattern including elliptical, oblong or square. It will be appreciated that the concentric rings 24 may have any repeating shape or pattern.

Although the raised portion 22 is illustrated as being centered on the insert 12, the raised portion may be offset. Additionally, more than one raised portion 22 may be provided, for example repeating the same shape or pattern or providing different shapes or patterns.

As illustrated in FIGS. 3A and 3B, the insert 12 has a bottom surface 28 opposite the top surface 20. The bottom surface 28 is preferably substantially planar and may be substantially parallel to the top surface 20. As illustrated, the bottom surface 28 surrounds a uniform concave portion 30. The bottom surface 28 of the insert 12 is illustrated greater detail in FIG. 16. In one example, the concave portion 30 corresponds to the shape and size of the raised portion 22. However, the concave portion 30 may have a different shape and/or size from the raised portion 22. The concave portion 30 also is recessed, at its maximum height, a distance $h_{cvp}$ spaced from a second plane $P_2$ defined by the bottom surface 28. The spacing of the various parts of the concave portion 30 from the plane of the bottom surface 28 may be varied, and may feature peaks 33 and valleys 35. Generally, the height $h_{cvp}$ of the concave portion may be any suitable distance relative to the thickness $t_{cp}$ of the insert 12. As illustrated, the height $h_{cvp}$ of the concave portion 30 is at least one-quarter the thickness $t_{cp}$ of the insert 12 at its edges, and preferably about half the thickness of the insert 12.

It will be appreciated that alternatively the bottom surface 28 could extend across the entire extent of insert 12 and that a concave portion 30 would not appear. In another embodiment, raised portion 22 could appear on both sides of insert 12 or concave portions 30 could appear on both sides of insert 12.

The raised portion 22 and concave portion 30 are preferably uniform in configuration. A uniform configuration means that the raised portion 22 or concave portion 30 has a shape and/or pattern that may include one or more of the following: radial symmetry of the raised or concave portion; symmetry between opposite sides of the raised or concave portion; constant spacing between features of the raised or concave portion; constant height or width of features of the raised or concave portion; constant rate of change of height or width of features of the raised or concave portion from the center to the outer edge; and constant height, width and/or cross-sectional shape within each feature of the raised or concave portion. By constant it is meant that they are substantially the same.

The embodiment of FIG. 1 has at least some of these characteristics that make the raised portion 22 and concave portion 30 uniform in configuration. The insert 12 has symmetry between opposite sides of the raised or concave portion, for example, when divided in half along lines 3A-3A and 3B-3B. Additionally, the individual spacings between each concentric ring 24, along with the width $w_r$ of the each concentric ring 24, is constant. The height $h_r$ between the valleys 23 and the peaks 25 for each ring is also constant. There is a constant rate of change of height above the plane of surface 20 for the peaks 23 and valleys 25 from the center to the outer edge 31 of the raised portion 22. There is also a constant rate of change in the height between peaks 33 and valleys 35 of concave section 30 and the plane of bottom surface 28. Thus, there is a consistent slope of the peaks 23 and 33 and valleys 25 and 35 of the respective raised and concave portions 22 and 30.

Now referring to FIGS. 4-10, different embodiments of the raised portion 22 on the insert 12 will be described. Although described with regard to the raised portion, it will be appreciated that each of these embodiments could also be used for the concave portion 30. The different embodiments are for illustrative purposes only, and are not intended to limit the invention.

Figure 4:
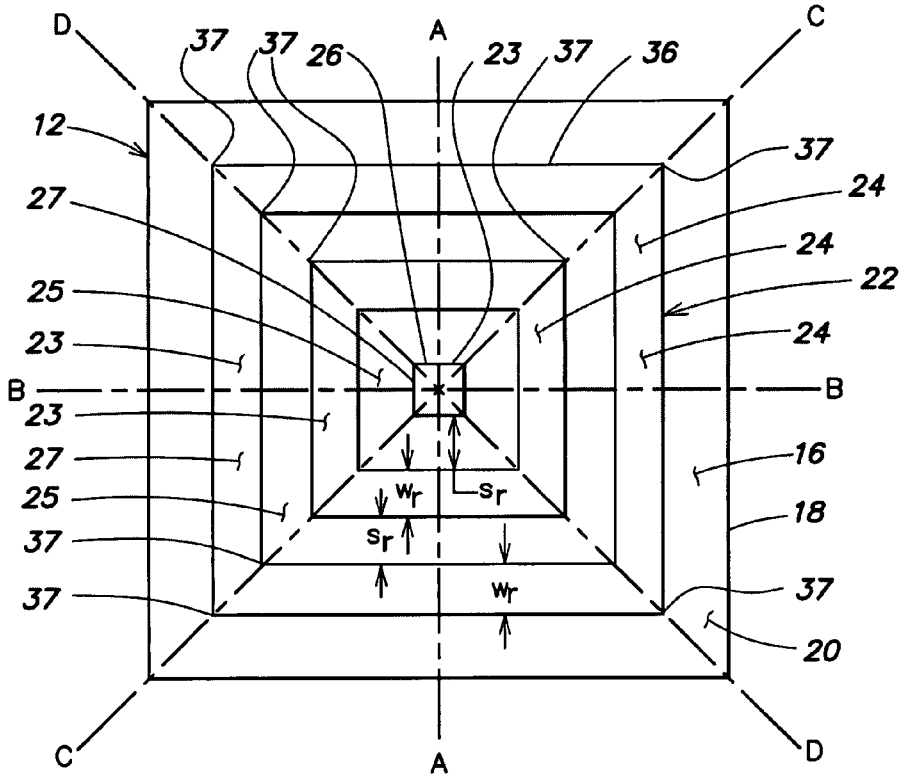
FIG. 4 is a front plan view of another embodiment of a door light according to the present invention.

FIG. 4 illustrates the center knob 26 as being square, while the concentric rings 24, of which there are two, also have an overall square configuration in the insert. Corners 37 are illustrated as being at about a 90° angle; however, it will be appreciated that the corners 37 may be rounded. This embodiment of the raised portion 22 of the insert 12 has a uniform configuration in at least one of the different ways described above. For example, the widths $w_r$ of the features 27 of the raised portion 22, such as the rings 24, are constant. The spaces Sr between the features 27 of the raised portion 22, such as the rings 24 and knob 26, are also constant in this embodiment. Additionally, the raised portion 22, if divided in half along either lines A-A, B-B, C-C or D-D, is symmetric.

Figure 5:
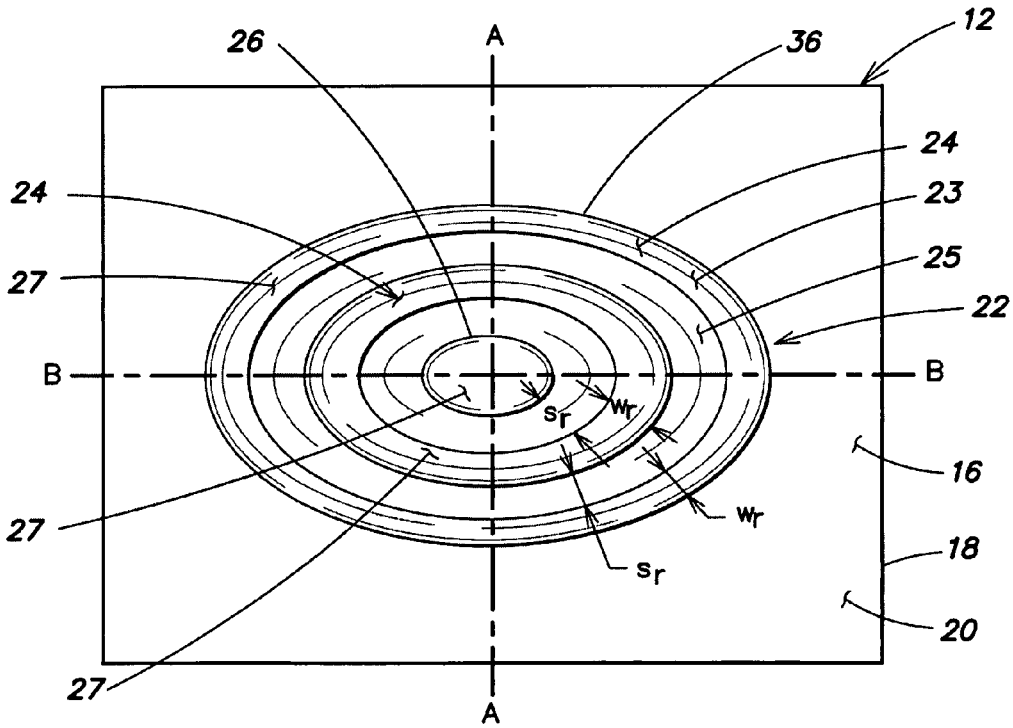
FIG. 5 is a front plan view of another embodiment of a door light according to the present invention.

FIG. 5 illustrates the center knob 26 as being elliptical, while the concentric rings 24, of which there are two, also have an overall elliptical configuration in the insert. The widths $w_r$ of the features 27 of the raised portion, such as rings 24 and knob 26, are illustrated as being varied between one another and on each feature individually. Additionally, the spaces $s_r$ between the features 27 of the raised portion 22, such as the rings 24 and knob 26, are also illustrated as being varied between one another and with variations within each space. This embodiment of the raised portion 22 of the insert 12 also has a uniform configuration as described above in at least one way. For example, the raised portion 22, if divided in half along either lines A-A or B-B, is symmetric.

Figure 6:
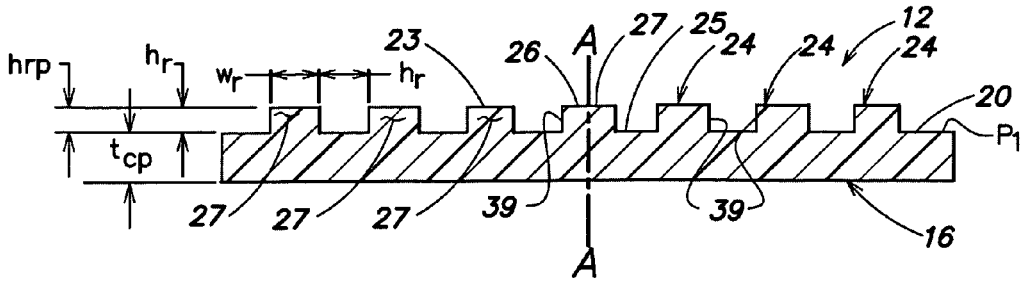
FIG. 6 is a side cross-sectional view showing another embodiment of a raised portion of a door light according to the present invention.
Figure 7:
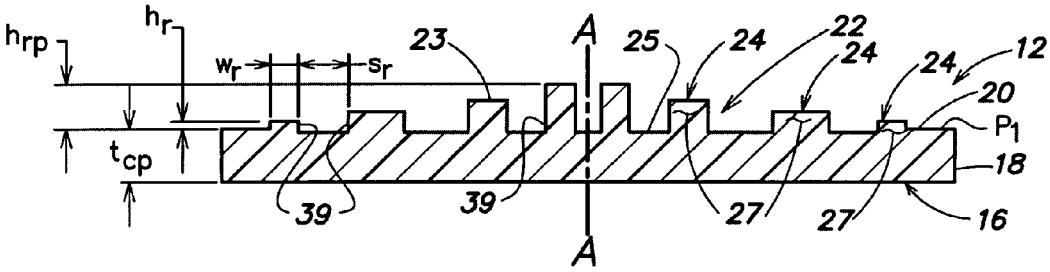
FIG. 7 is a side cross-sectional view showing another embodiment of a raised portion of a door light according to the present invention.
Figure 8:
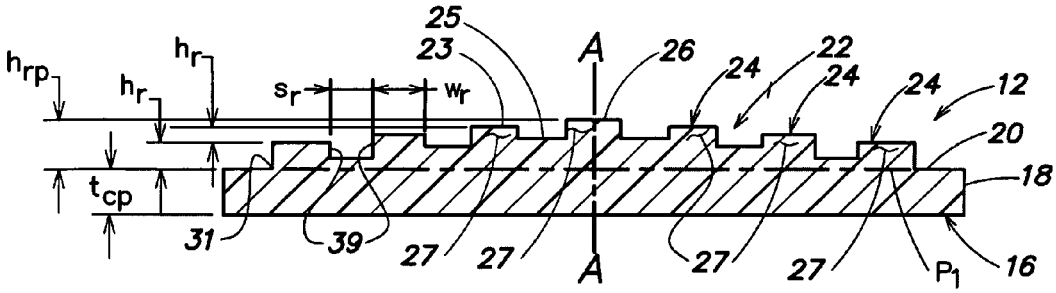
FIG. 8 is a side cross-sectional view showing another embodiment of a raised portion of a door light according to the present invention.

FIGS. 6-10 show different cross-sections of different raised portions 22 for an insert. These different embodiments could also be used for the concave portion 30. Each embodiment of the raised portion 22 includes at least one characteristic that is described above as making the configuration of the raised portion 22 uniform. FIG. 6 illustrates the raised portion 22 having constant widths $w_r$, heights $h_r$ and cross-sectional shapes for the features 27 of the raised portion 22, including the knob 26 and rings 24. The spacings $s_r$ between the features 27 are also constant. The raised portion 22 at least has symmetry along line A-A dividing the raised portion in half. FIG. 7 illustrates the raised portion 22 with the features 27 being concentric rings 24, but not having a knob 26. The concentric rings 24 have different widths $w_r$, heights $h_r$ and cross-sectional shapes, which vary from square to rectangular. However, at least when divided along line A-A, the raised portion 22 may have symmetry. FIG. 8 shows a raised portion 22 with features 27, including a knob 26 and concentric rings 24, with a constant rate of change in height above the plane of surface 20 for the peaks 23 and valleys 25 from the center to the outer edge 31 of the raised portion 22. The concentric rings 24 also have the a constant width $w_r$. The raised portion 22 may at least have symmetry along line A-A. FIGS. 6-8 illustrate the concentric rings 24 and knob 26 as having sidewalls 39 being perpendicular to the top surface 20 and valleys 23 between the features 27 of the raised portion 22.

Figure 9:
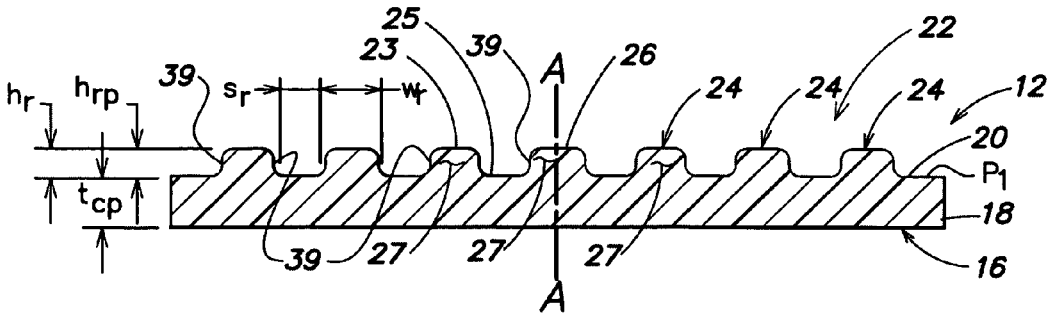
FIG. 9 is a side cross-sectional view showing another embodiment of a raised portion of a door light according to the present invention.
Figure 10:
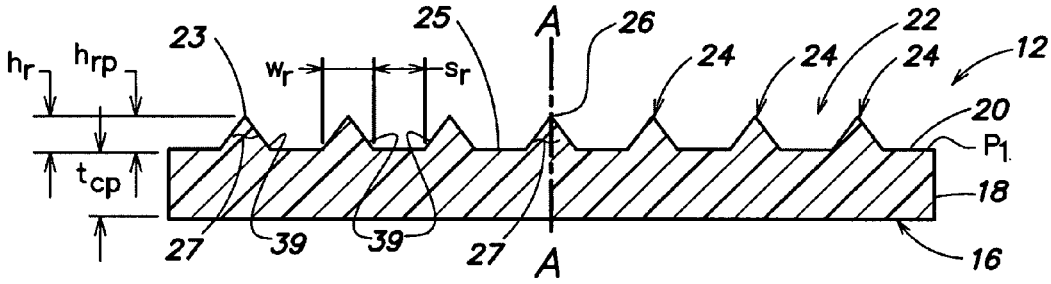
FIG. 10 is a side cross-sectional view showing another embodiment of a raised portion of a door light according to the present invention.

FIG. 9 illustrates yet another embodiment for the raised portion 22. FIG. 9 illustrates the raised portion 22 having constant widths $w_r$, heights $h_r$ and cross-sectional shapes for the features 27 of the raised portion, including the knob 26 and rings 24. The concentric rings 24 and knob 26 have sidewalls 39 with curved interfaces that meet with the top surface 20 of the insert, peaks 23 and valleys 25. The raised portion 22 may at least have symmetry along line A-A. FIG. 10 illustrates yet another embodiment for the raised portion 22. The concentric rings 24 feature triangular cross-sectional shapes. The knob 26 may be a cone shape. Each concentric ring 24 and knob 26 has a constant width $w_r$ and height $h_r$, and the spacing $s_r$ between the rings 24 and knob 26 is also constant. The raised portion 22 at least has symmetry along line A-A.

Referring again to FIG. 1, the raised portion 22 includes two truncated sides 32 and 34. The truncated sides 32 and 34 truncate the concentric ring pattern by interrupting two of the concentric rings 24 on two opposing sides of the raised portion. The truncated sides 32 and 34 are substantially perpendicular to the top surface 20 of the insert 12. Alternatively, the truncated sides 32 and 34 may be provided at any angle relative to the top surface 20, or feature a curved interface with the top surface 20. The two truncated sides 32 and 34 are provided opposite one another, such that they are substantially parallel to one another. Each truncated side 32 and 34 is spaced a distance $d_t$ from the outer edge 18 of the insert 12, and the remaining edges 36 of the raised portion 22 are spaced a distance $d_{re}$ at their closest point to the outer edge 18.

Referring now to FIGS. 11-13B, a second embodiment of the door light is shown with insert 38. The insert 38 is substantially the same as the insert illustrated in FIGS. 1-3B; however, there are a few differences which will be discussed in more detail below.

Figure 11:
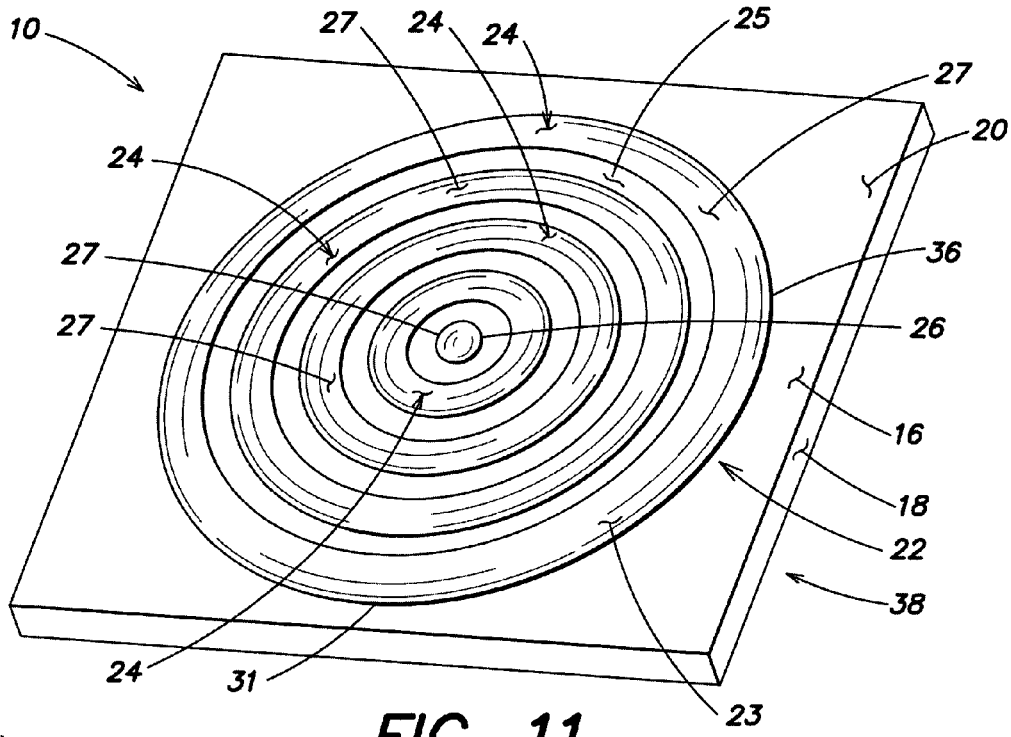
FIG. 11 is a perspective view of yet another embodiment of a door light according to the present invention.
Figure 12:
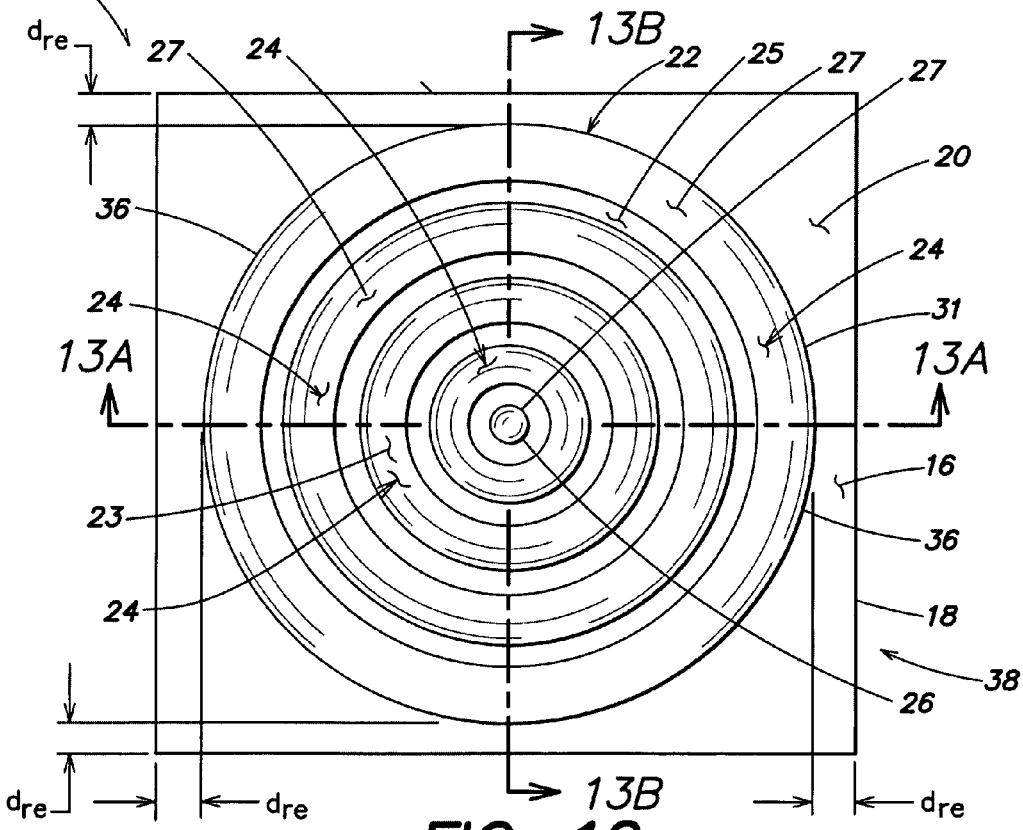
FIG. 12 is a front plan view of the door light of FIG. 11.

The insert 38 has an overall square shape. As shown in FIGS. 11-12, uniform raised portion 22 includes a knob 26 and four concentric rings 24 like the first embodiment. However, unlike the previous embodiment, the concentric rings 24 are not interrupted by truncated sides on the raised portion 22. Instead, the concentric rings 24 are complete. The raised portion 22 is centered on the insert 38.

Figure 13B:
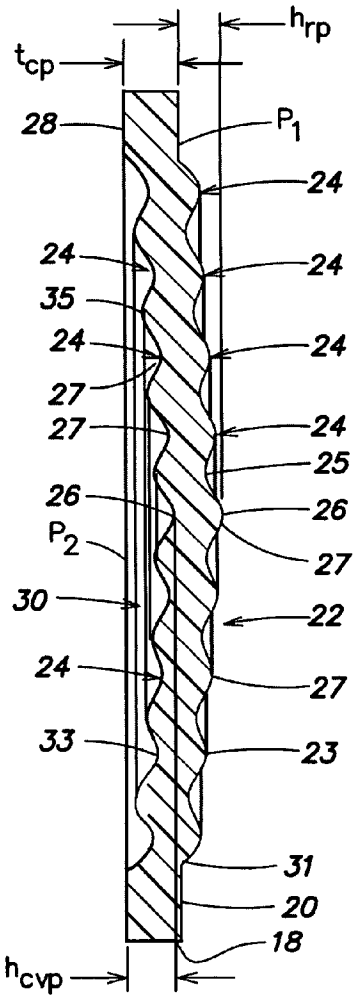
FIG. 13B is a side cross-sectional view of the door light of FIG. 11 taken along line 13B-13B of FIG. 12.
Figure 13A:
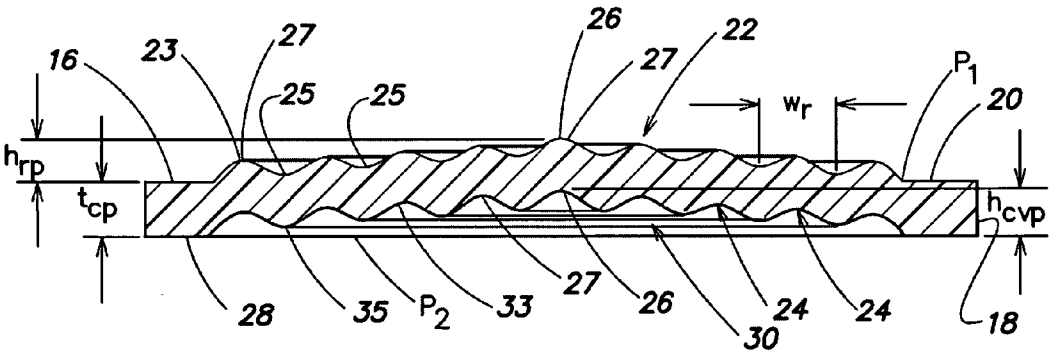
FIG. 13A is a side cross-sectional view of the door light of FIG. 11 taken along line 13A-13A of FIG. 12.
Figure 14:
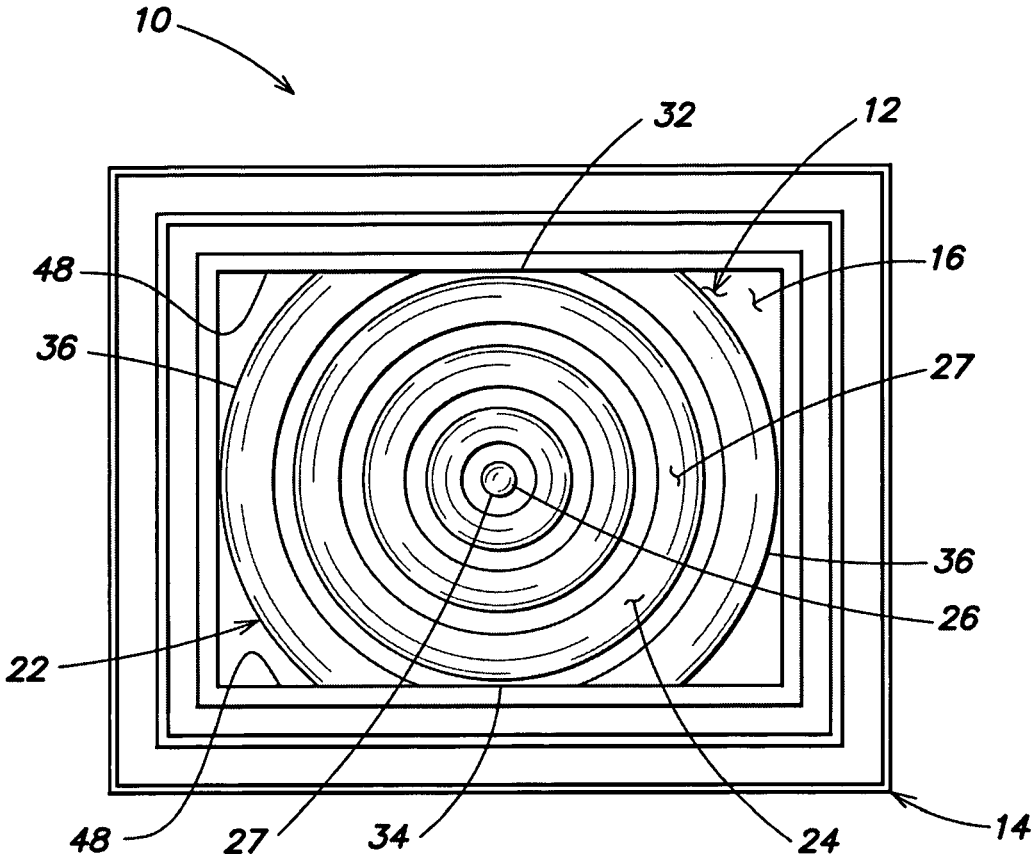
FIG. 14 is a front plan view of the door light of FIG. 1 in a frame.

Referring to FIGS. 13A and 13B, the raised portion 22 extends, at a maximum height, a height $h_{rp}$ from the plane of the top surface 20 and features a matching concave portion 30 recessed from the plane of the bottom surface 28 of the insert 38, at a maximum height, a distance $h_{cvp}$. The outermost edge 36 of the raised portion 22 is spaced a distance $d_{re}$ at its closest points to the outer edge 18.

The embodiment of FIG. 11 has at least some of the above described characteristics that make the raised portion 22 and concave portion 30 of a uniform configuration. The insert 38 at least has radial symmetry, and has symmetry between opposite sides of the raised or concave portions 22 and 30, for example when divided in half along lines 13A-13A and 13B-13B. Additionally, the individual spacings $s_r$ between each concentric ring 24, along with the width $w_r$ of the each concentric ring 24, is constant. The height $h_r$ between the peaks 23 and the valleys 25 for each ring is also constant. There is a constant rate of change of height above the plane of surface 20 for the peaks 23 and valleys 25 from the center to the outer edge 31 of the raised portion 22. There is also a constant rate of change in the height between peaks 33 and valleys 35 of concave portion 30 and the plane of the bottom surface 28. Thus, there is a consistent slope of the peaks 23 and 33 and valleys 25 and 35 of the respective raised and concave portions 22 and 30.

The inserts may be made of any suitable material resulting in a substantially shatterproof or impact resistant insert. The insert may be made of any suitable plastic, for example acrylic, polycarbonate, polyethylene terephthalate, polystyrene PS, and unplasticized polyvinyl chloride or a combination thereof. Preferably the insert is made of a polycarbonate. Light may filter through the insert. Preferably, the insert is at least translucent and may be at least partially transparent. The material may be tinted in a variety of colors.

The insert may be made by any suitable method or process, including molding. Preferably, the insert is made by injection molding. Pellets of material are heated and the melted material is then injected into a mold. The material is allowed to dry for a period of time. The thicker the insert the longer the time period the material will need for drying. For example, when the thickness $t_{cp}$ is about one-half inch the drying time may be about four minutes. The insert is then released from the mold and is ready to be placed in a frame for placement in a door.

Preferably, the insert is a single piece, although the insert could potentially be made of separate pieces. For example, the insert 12 and the raised portion 22 could be made separately and secured together using fasteners or adhesive.

Figure 15:
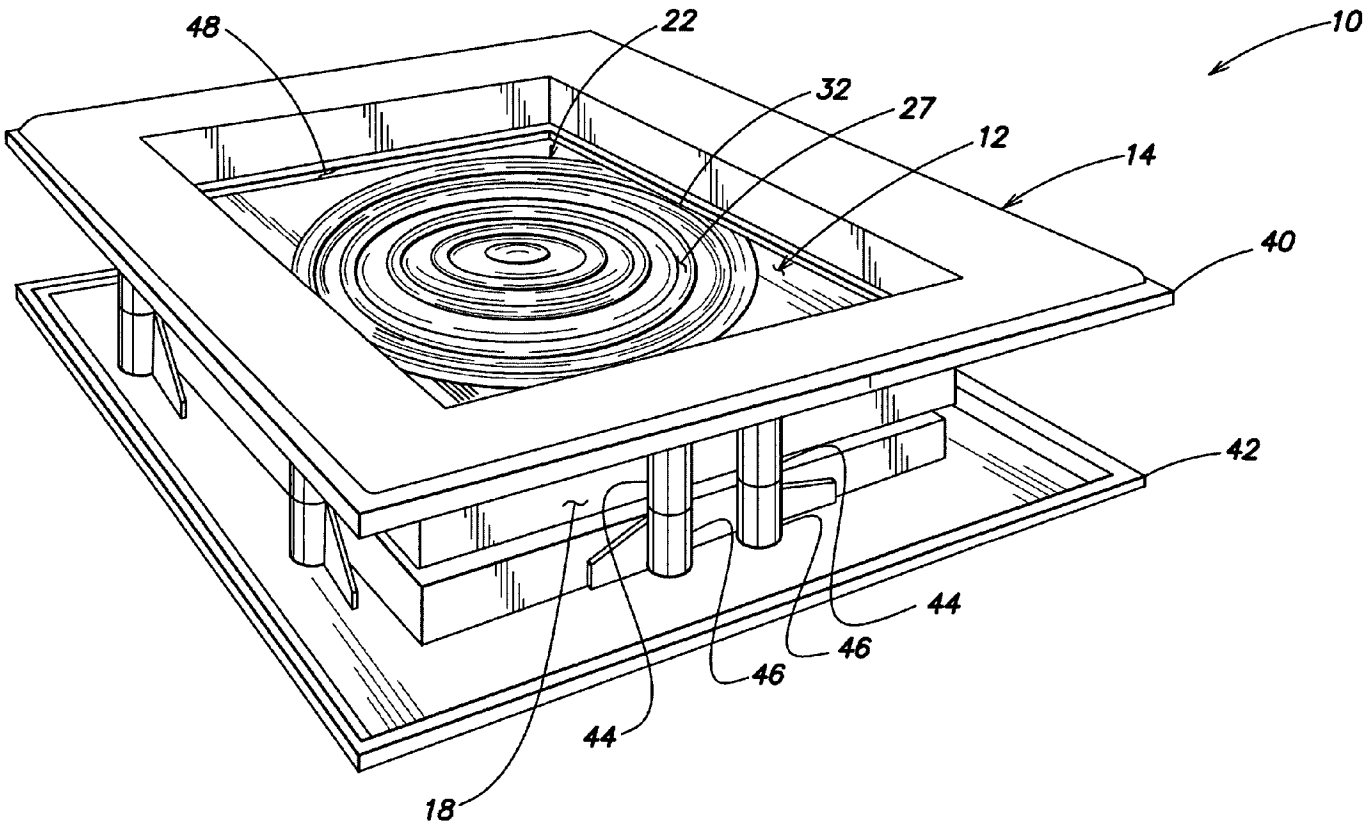
FIG. 15 is a front perspective view of the door light of FIG. 1 in a frame.
Figure 16:
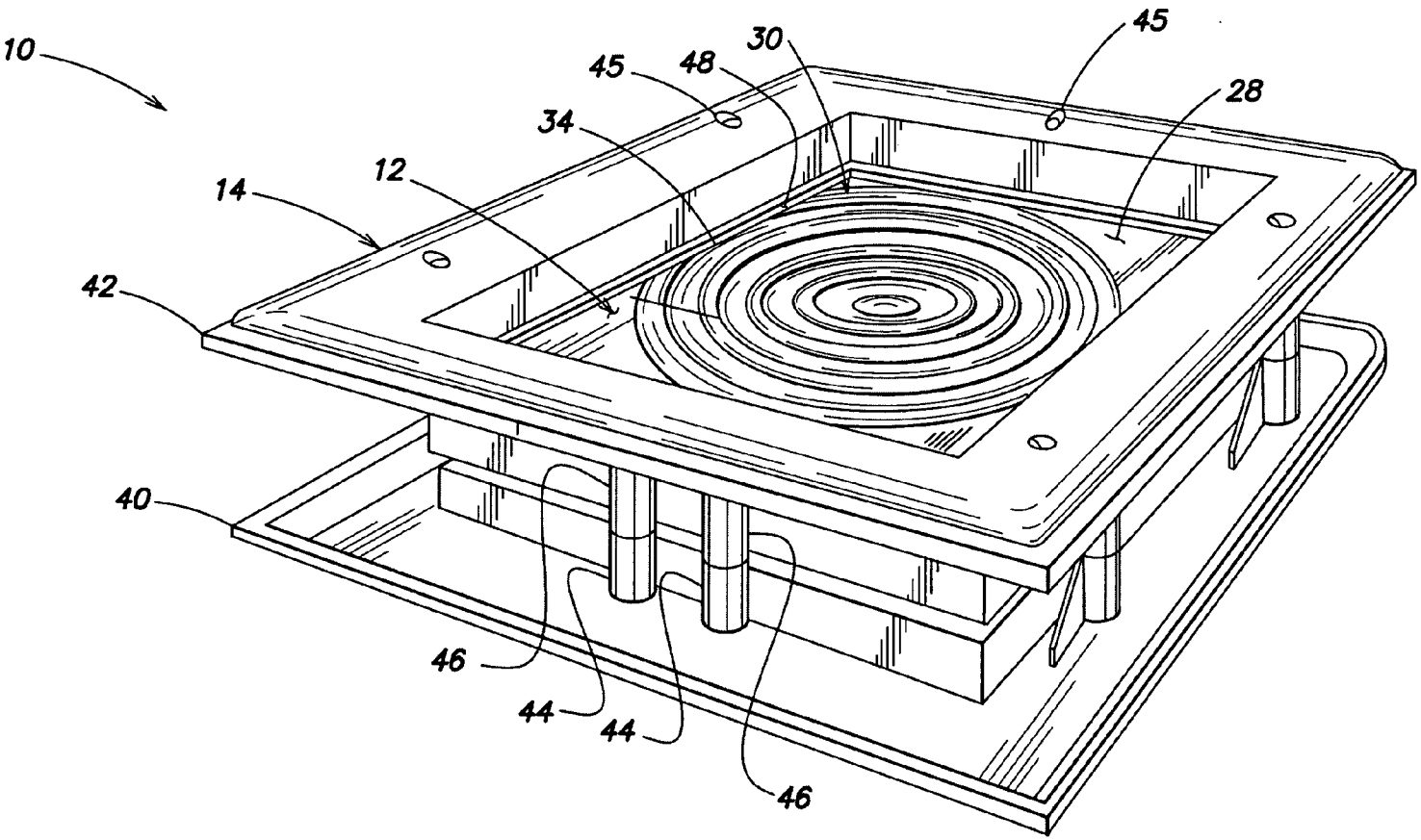
FIG. 16 is a rear perspective view of the door light of FIG. 1 in a frame.

Referring now to FIGS. 14-17, the first embodiment of the insert 12 is shown provided in a frame 14. It will be appreciated that any suitable frame may be used to hold the insert. As illustrated in FIGS. 15 and 16, the frame 14 may include a front half and rear half 40 and 42. The front and rear halves 40 and 42 may be secured together with the insert in-between using interfitting posts 44 and 46, as is known in the framing art. Fasteners 45, such as screws, may be inserted through the rear half 42 into the posts 44 and 46 to secure the rear half to the front half with the insert in-between. The raised portion 22 may abut or be spaced from an inner edge 48 of the frame. As illustrated, the edge 36 of the raised portion 22 is spaced from the inner edge 48, while the truncated sides 32 and 34 abut the inner edge 48 of the frame 14. Because a portion of the inner edge 48 and truncated sides 32 and 34 may be parallel one another, the truncated sides may abut the inner edge along the entire length of the truncated sides 32 and 34. The posts 44 and 46 may abut the outer edge 18 of the insert 12 to center the insert within the frame 14. Thus, it is not necessary for the raised portion 22 or even the truncated sides 32 and 34 to abut the inner edge 48 of the frame 14 in order to hold the insert 12 steady within the frame 14.

Figure 17:
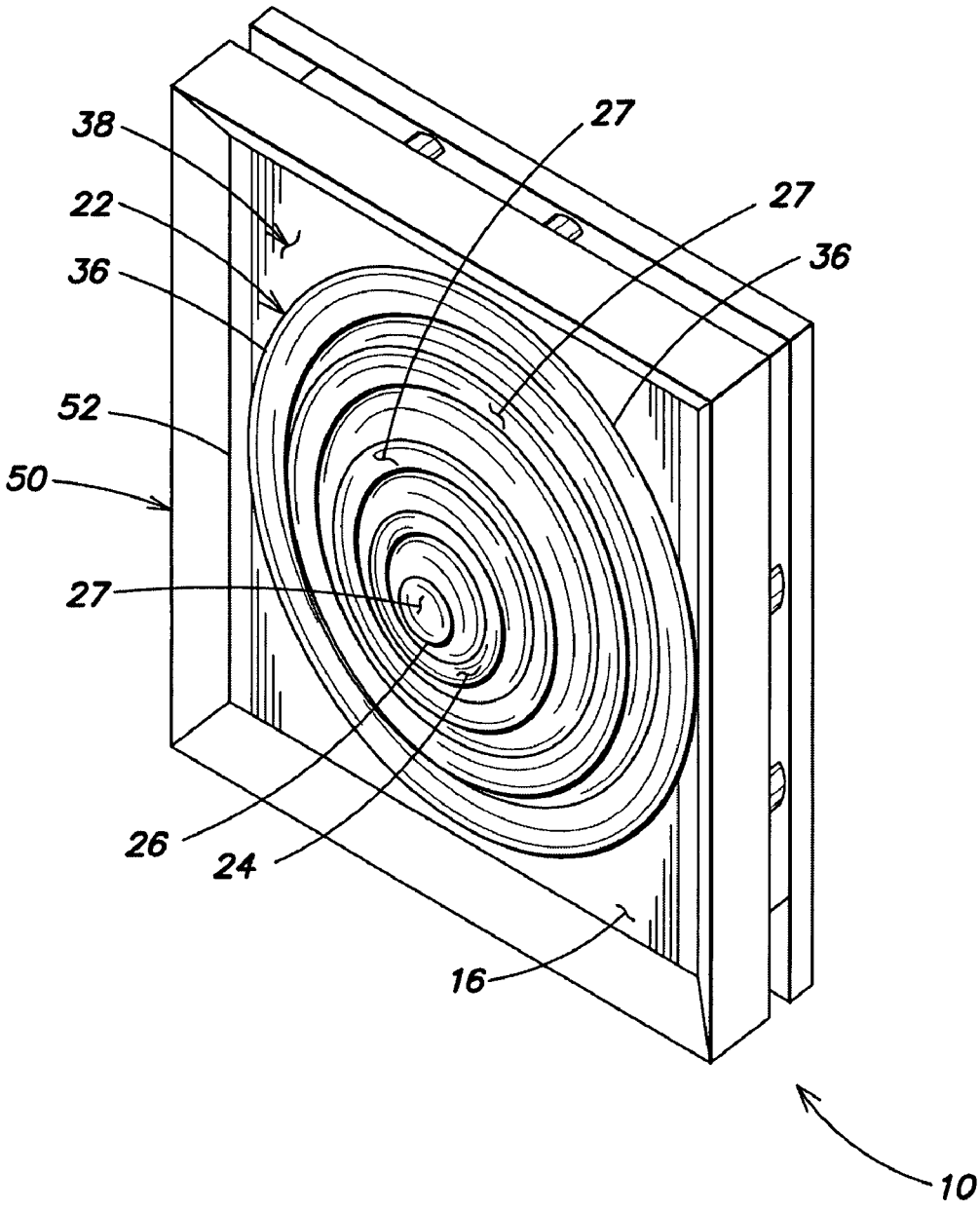
FIG. 17 is a front perspective view of the door light of FIG. 11 in a frame.

FIG. 17 illustrates the second embodiment of the insert 38, in a frame 50. As shown, the edges 36 of the raised portion 22 are spaced from an inner edge 52 of the frame 50. However, portions of the edge 36 of the raised portion 22 could abut the inner edge 52 of the frame 50. Frame 50 may be any suitable frame.

The frames 14 and 50 may be made of any suitable material, which may depend on the type of door or window they are set within. The frame may be made of plastic, including vinyl.

The framed door lights may be used anywhere in a home or other building. In one particular application, the framed door light may be used with any door or window, including fiberglass, steel or wood doors or windows. The door light may be set within doors or windows or adjacent doors or windows as a side light or transom. The door lights may be used on either exterior or interior of buildings to allow light to filter through the door light from outside the building into the interior of the building or from one interior room into another.

Having thus described several aspects of at least one embodiment of this invention, it is to be appreciated various alterations, modifications, and improvements will readily occur to those skilled in the art. Such alterations, modifications, and improvements are intended to be part of this disclosure, and are intended to be within the spirit and scope of the invention. Accordingly, the foregoing description and drawings are by way of example only.

What is claimed is:

1. An insert for placement in a door light, the insert comprising:

a substantially planar top surface defining a plane;

a raised portion at least partially surrounded by the top surface, the raised portion including at least two features which are raised with respect to the plane of the top surface, the raised portion having a substantially uniform configuration, and the raised portion defining an upper surface;

wherein the at least two features on the raised portion include at least two raised concentric rings substantially centered on the insert;

a substantially planar bottom surface spaced from and disposed substantially in parallel relation to the top surface;

a recessed portion at least partially surrounded by the bottom surface, the recessed portion including at least two features which are recessed with respect to the bottom surface, and the recessed portion defining a lower surface;

wherein the at least two features on the recessed portion include at least two recessed concentric rings which substantially correspond in shape and size to the at least two raised concentric rings on the raised portion, and wherein the distance between the upper surface of the raised portion and the lower surface of the recessed portion is substantially uniform throughout.

2. The insert of claim 1, wherein the raised portion includes a bullseye configuration, having at least two concentric circles.

3. The insert of claim 1, wherein the planar top surface of the insert has a thickness, the raised portion has a maximum height, and the maximum height is at least one-quarter the thickness.

4. The insert of claim 1, wherein the insert is formed of a plastic material, and the plastic material is selected from the group consisting of acrylic, polycarbonate, polyethylene terephthalate, polystyrene PS, and unplasticized polyvinyl chloride.

5. The insert of claim 1, further comprising:

a frame having at least a part of the frame abutting an outer edge of the insert to center the insert within the frame, wherein the frame forms a central opening for exposing the raised portion of the insert.

6. The insert of claim 1, wherein the at least two raised concentric rings include an inner ring and an outer ring, wherein the maximum height of the inner ring is greater than the maximum height of the outer ring.

7. The insert of claim 1, wherein the at least two raised concentric rings include an inner ring and an outer ring, wherein the maximum height of the inner ring is substantially equal to the maximum height of the outer ring.

8. The insert of claim 1, wherein at least one of the concentric rings is a complete, uninterrupted ring.

9. The insert of claim 1, wherein the raised portion has a plurality of peaks, wherein a maximum height of the peaks is substantially centered on the raised portion, a height of the peaks of the raised portion decreasing at a constant rate in a radial direction from the maximum height toward an outer edge of the raised portion.

10. An insert for placement in a door light, the insert comprising:

a substantially planar top surface defining a plane;

a raised portion at least partially surrounded by the top surface, the raised portion including at least two features which are raised with respect to the plane of the top surface, the raised portion having a substantially uniform configuration, wherein the at least two features on the raised portion include at least two raised concentric rings;

an outer edge of the raised portion; and at least one substantially linear truncated side provided on a portion of the outer edge and interrupting at least an outermost concentric ring such that the at least an outermost concentric ring is incomplete, wherein the truncated side is substantially perpendicular to the planar top surface.

11. The insert of claim 10, further comprising:

two truncated sides provided on opposite portions of the outer edge of the raised portion and substantially parallel to one another.

12. The door light of claim 10, wherein the raised portion includes a bullseye pattern, having at least two concentric circles.

13. The door light of claim 10, wherein the raised portion has a plurality of peaks, wherein a maximum height of the peaks is substantially centered on the raised portion, a height of the peaks of the raised portion decreasing at a constant rate in a radial direction from the maximum height toward on outer edge of the raised portion.

14. The door light of claim 10, further comprising:

a substantially planar bottom surface spaced apart from and disposed substantially in parallel relation to the top surface, the planar bottom surface defining a second plane;

a recessed portion at least partially surrounded by the bottom surface, the recessed portion including at least two features which are recessed with respect to the bottom surface, the recessed portion defining a lower surface, and the raised portion defining an upper surface;

wherein the at least two features on the recessed portion include at least two recessed concentric rings which substantially correspond in shape and size to the at least two raised concentric rings on the raised portion, and wherein the distance between the upper surface of the raised portion and the lower surface of the recessed portion is substantially uniform throughout.

15. The door light of claim 10, wherein the insert is formed of a material selected from the group consisting of acrylic, polycarbonate, polyethylene terephthalate, polystyrene PS, and unplasticized polyvinyl chloride.

16. The insert of claim 10, wherein the insert is formed of a substantially shatterproof material.

17. In combination:

a door; and an insert for placement in the door, the insert comprising a substantially planar top surface defining a plane, and a raised portion at least partially surrounded by the top surface, the raised portion including at least two features which are raised with respect to the plane of the top surface, the raised portion having a substantially uniform configuration;

wherein the at least two features on the raised portion include at least two raised concentric rings, defining an inner ring and an outer ring, wherein the maximum height of the inner ring is greater than the maximum height of the outer ring, and wherein the maximum height of the raised portion is at the center of the concentric rings, and the maximum height of each concentric ring decreases progressively towards the outer edge of the raised portion.

18. The combination of claim 17, wherein the raised portion includes a bullseye configuration, having at least two concentric circles.

19. The combination of claim 17, wherein the insert is formed of a plastic material.

20. The combination of claim 17, wherein at least one of the concentric rings is a complete, uninterrupted ring.

21. The combination of claim 17, further comprising an outer edge of the raised portion; and at least one truncated side provided on a portion of the outer edge and interrupting at least an outermost concentric ring, wherein the truncated side is substantially perpendicular to the planar top surface.

22. In combination:

a door; and an insert for placement in the door, the insert comprising:

a substantially planar top surface defining a plane;

a raised portion at least partially surrounded by the top surface, the raised portion including at least two features which are raised with respect to the plane of the top surface, the raised portion having a substantially uniform configuration, and the raised portion defining an upper surface, wherein the at least two features on the raised portion include at least two raised concentric rings substantially centered on the insert;

a substantially planar bottom surface spaced from and disposed substantially in parallel relation to the top surface; and a recessed portion at least partially surrounded by the bottom surface, the recessed portion including at least two features which are recessed with respect to the bottom surface, the recessed portion defining a lower surface;

wherein the at least two features on the recessed portion include at least two recessed concentric rings which substantially correspond in shape and size to the at least two raised concentric rings on the raised portion, and wherein the distance between the upper surface of the raised portion and the lower surface of the recessed portion is substantially uniform throughout.

23. In combination:

a door; and an insert for placement in the door, the insert comprising:

a substantially planar top surface defining a plane; and a raised portion at least partially surrounded by the top surface, the raised portion including at least two features which are raised with respect to the plane of the top surface, the raised portion having a substantially uniform configuration;

wherein the at least two features on the raised portion include at least two raised concentric rings, an outer edge of the raised portion, and at least one substantially linear truncated side provided on a portion of the outer edge and interrupting at least an outermost concentric ring such that the at least an outermost concentric ring is incomplete, wherein the truncated side is substantially perpendicular to the planar top surface.

* * * * *